United States Patent [19]

Pinior

[11] 4,184,770

[45] Jan. 22, 1980

[54] MONITORING SYSTEMS

[75] Inventor: Gernot Pinior, Olching, Fed. Rep. of Germany

[73] Assignee: Erwin Sick Gesellschaft mit beschrankter Haftung Optik-Elektronik, Fed. Rep. of Germany

[21] Appl. No.: 866,730

[22] Filed: Jan. 3, 1978

[30] Foreign Application Priority Data

Jan. 3, 1977 [DE] Fed. Rep. of Germany ..... 2700004

[51] Int. Cl.$^2$ ..... G01B 11/30

[52] U.S. Cl. ..... 356/430; 250/572

[58] Field of Search ..... 356/199, 200, 429, 430, 356/431; 250/571, 572

[56] References Cited

U.S. PATENT DOCUMENTS

| | | | |
|---|---|---|---|
| 3,072,012 | 1/1963 | Pandell et al. | 356/199 |
| 3,105,152 | 9/1963 | Nash | 356/200 |
| 3,588,513 | 6/1971 | Aramatsu et al. | 356/430 |
| 3,841,761 | 10/1974 | Selgin | 356/200 |
| 3,877,814 | 4/1975 | Hess et al. | 356/200 |
| 3,992,111 | 11/1976 | Roulier et al. | 250/572 |
| 4,021,119 | 5/1977 | Stauffer | 356/199 |

*Primary Examiner*—John K. Corbin
*Assistant Examiner*—R. A. Rosenberger
*Attorney, Agent, or Firm*—Townsend & Townsend

[57] ABSTRACT

A monitoring system for detecting the presence of folds, creases, etc., in the surface of a moving web of material such as paper. The system utilizes a laser light beam arranged parallel to the surface of the web and transversely to the direction of movement thereof. A light detector such as a differential photo electric detector senses changes in the light beam caused by impingement on a fold or crease.

9 Claims, 4 Drawing Figures

MONITORING SYSTEMS

The present invention relates to a monitoring apparatus and has particular reference to an electro-optical monitoring system for checking for the presence of creases or other surface irregularities in a moving web of material.

Apparatus is already known for monitoring the presence of faults in a continually moving web of material especially a paper web. The purpose of this monitoring apparatus is to automatically recognise the presence of a fault arising for example during the process of manufacturing the web of paper. With the known monitoring apparatus the scanning ray generally impinges at right angles on the web of material. The recognition of creases or surface irregularities is therefore relatively difficult.

The present invention seeks to provide an electro optical crease monitoring apparatus of the previously mentioned kind that in simple and certain manner and of relatively inexpensive construction can automatically recognise the presence of creases in the web.

According to the present invention there is provided a monitoring system for monitoring the presence of irregularity in the surface of a movable web of material comprising means for directing a sharply defined light beam closely parallel to the surface of the web and transversely to the direction of movement thereof and a photo electric light receiving device arranged in the vicinity of the light beam the output signal of which changes in response to a change in the light received on the entry of the irregularity into the path of the light beam.

By an irregularity will be understood, without restriction, any local raising of the surface of the web such as a wrinkle, crease, fold or as might be caused by the entrapment of a foreign body in the material of the web.

Because the light beam is directed closely parallel to the surface of the web, i.e. so that it just grazes the surface of the web even trivial irregularities in the form of locally raised areas of the surface will lead to interruption, remission or reflection of at least part of the light beam which can be used for measurement by the photo electric receiving device.

The light ray is preferably delivered by a laser because this can be sharply defined and aligned parallel to the web of material in the necessary manner with little constructional expense. Advantageously the light ray is directed practically at right angles to the direction of movement of the web.

A very simply realised circuit for the production of a fault signal comprises the impingement of the light ray, after it has crossed the web on a differential photo receiving device that is connected to a difference amplifier. The differential photo receiving device is usefully so adjusted that the difference signal is zero when no creases is present. If a crease should now run through the optical light path then a part of the light beam will be covered up and a fault signal will be present at the output of the difference amplifier.

A further advantageous embodiment is so constructed that the light receiving device is arranged alongside the light beam and receives light remitted or reflected from a crease. Known scanning devices working with autocollimation or a reflection type light conducting rod can usefully be used for this purpose.

In order to achieve an absolutely trouble free parallel alignment between the surface of the web and the light beam the web is preferably led over a roller whereby the light ray should extend essentially parallel to the axis, and hence the surface, of the roller. In as much as sagging of the roller is to be expected on account of its weight and the effects of gravity the direction of the light beam can usefully deviate slightly from axis of the roller so that the beam is nevertheless aligned closely parallel to the surface of the web despite any sagging that is present.

The closely parallel 'grazing' alignment of the laser beam on the surface of the web of material can be usefully and simply realised by making the light beam from the lasers fall at an angle on two optical wedges or prisms which are rotatable about the optical axis and by means of which the position of the light beam can be adjusted.

Embodiments of the invention will now be particularly described by way of example only and with reference to the accompanying drawings in which.

Figure 3:
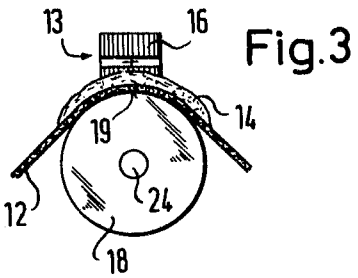
Figure 1:
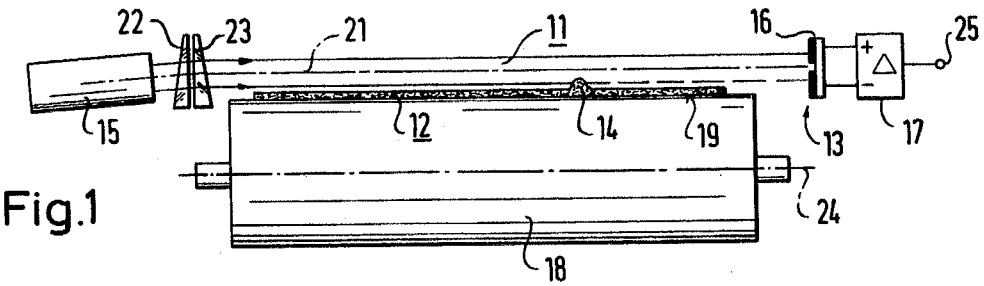
FIG. 1 is a partly cut away schematic side view of an electro optical crease monitoring apparatus.
Figure 2:
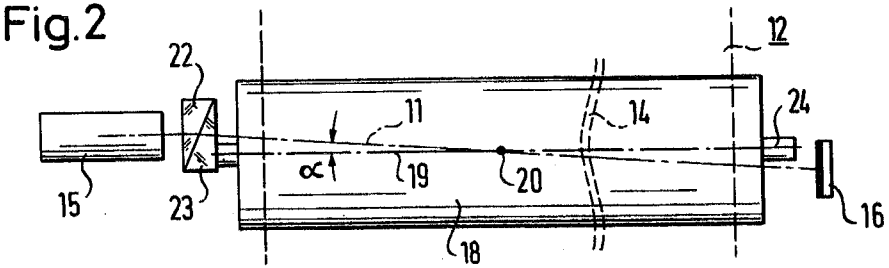
FIG. 2 is a plan view of the subject of FIG. 1.

FIG. 3 an end view of the subject of FIGS. 1 and 2 and

Figure 4:
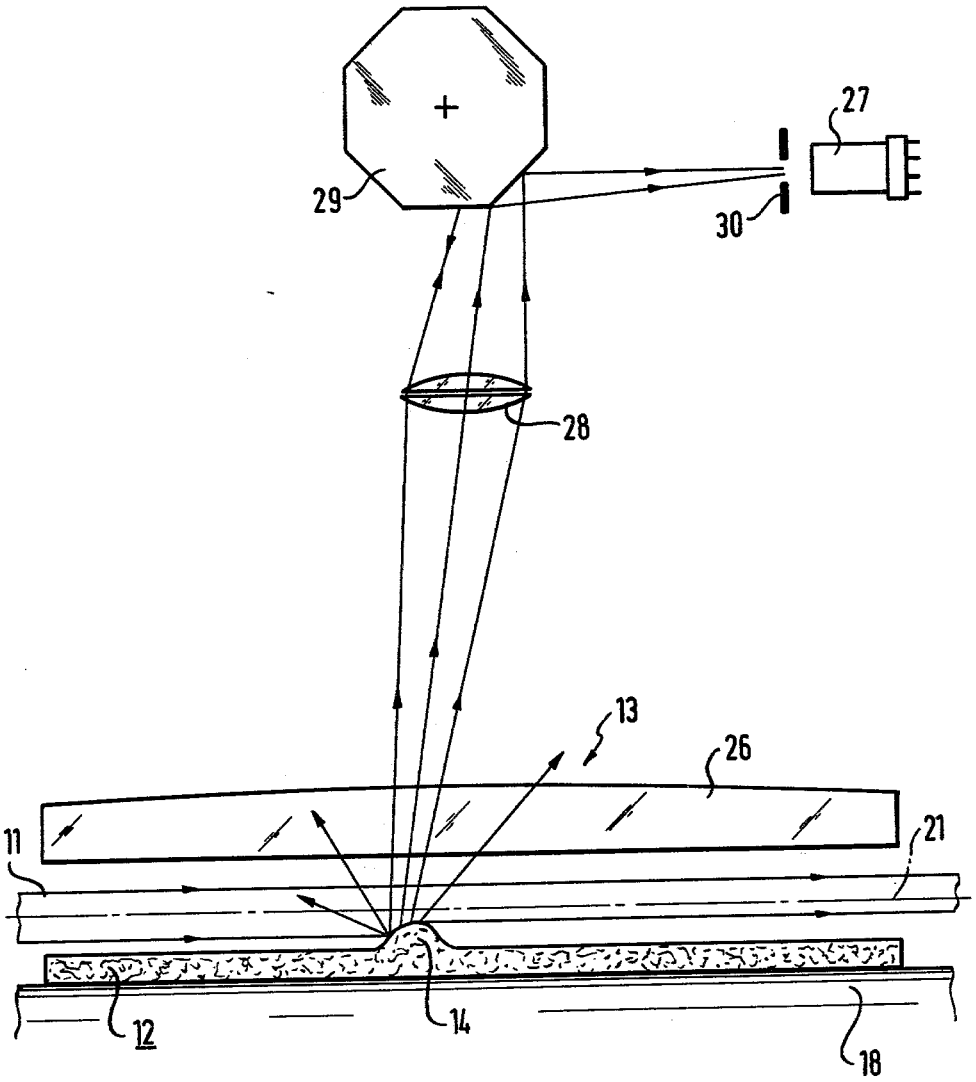

FIG. 4 is a view similar to FIG. 1 of a further embodiment.

Refering now to FIGS. 1 to 3 a web of paper 12 is shown which is being continually advanced over the surface of roller 18 which is rotatable about an axis 24. One of the creases appearing in the web of paper is indicated at 14.

A parallel and sharply defined light beam which is produced from a laser 15 via two rotatable wedges 22,23 extends over the uppermost surface line 19 of the roller 18 parallel to the axis of the roller. By means of the wedges 22,23 which are independently rotatable about the optical axis 21, the laser beam can be aligned with the surface of the web of paper 12.

After the light beam 11 has crossed the web of material, i.e. to the other side of the roller, it falls on a light receiving device 13 which comprises a differential photo cell 16 with an attached difference amplifier 17.

As the roller 18 sags a little the light beam 11 of FIG. 2 does not run exactly parallel to the surface line **19*a* but rather deviates by a small angle from this line. By this means and despite the sagging of the roller the light beam can reach all positions on the surface of the web. That is, the light beam 11 as seen in the plan view of FIG. 2 is tipped about an axis 20 which is located at the middle point of the roller 18** i.e. at the point where the greatest sag occurs.

After the light beam 11 has been exactly aligned closely parallel to the surface of the web 12 so that it just grazes this surface the height of the differential photo cell 16 is adjusted unitl no signal appears at the output 25 of the difference amplifier 7. Should a crease 14 now occur in the path of the light beam one element of the differential photo receiver 16 will receive somewhat less light and a signal will appear at the output 25 signifying the presence of the crease. This remains until the crease has completely moved out of the path of the light ray.

Turning now to the embodiment of FIG. 4 there can be seen an arrangement in which the light receiving device 13 is arranged alongside the light ray 11. The receiving device also extends at right angles to the direction of movement of the web 12.

The light receiving device 13 of FIG. 4 comprises a cylindrical lens 26 disposed directly above the light beam 11 which deflects the light to a photo electric converter 27, this is done in known manner using papillary division or autocollimation and via an objective lens 28, a mirror scanning wheel 29, (in this case a reflecting body of octagonal section ) and a slit 30 arranged in front of the converter 27.

A crease 14 entering into the light ray 11 reflects or remits a part of the light towards the cylindrical lens 26 which guides the light to the photo electric converter 27 which gives a corresponding electrical signal.

In principle any receiver working with autocollimation or a reflection light conducting rod can be used in similar fashion to the customary way it would be used in the known fault monitoring device with a light ray incident at right angles on the web.

What we claim is:

1. Apparatus for monitoring the presence of an irregularity in the surface of a web of material during movement of the web over a curved guide surface having an axis of curvature which is aligned transversely to the direction of movement of the web and which guide surface is subject to sagging deflection, the monitoring apparatus comprising means for directing a sharply defined light beam skewed at a slight angle relative to said axis of curvature over the surface of the web of material so as to ensure that the light beam is aligned closely parallel to the surface of the web to thereby compensate for the sagging deflection, and photoelectric light receiving means arranged in the vicinity of the light ray for generating an output signal which changes as a function of the change in the light received by the light receiving means in response to the entry of the irregularity into the light beam.

2. Apparatus according to claim 1 wherein the light beam comprises a laser beam.

3. Apparatus according to claim 1 wherein the light beam is received by the said light detecting means after it crosses the web, the last mentioned means comprising a differential photo-receiver and a differential amplifier operatively coupled therewith.

4. Apparatus according to claim 1 wherein the light detecting means is arranged alongside the light beam and receives light reflected from the surface irregularity.

5. Apparatus according to claim 1 wherein the guide surface comprises a cylindrical surface of a roller.

6. Apparatus according to claim 1 wherein the means for directing comprises a laser, and including first and second successive optical wedges positioned to intercept the light beam generated by the laser, the wedges being further oriented so that the light beam impinges thereon at an angle, the wedges being rotatable about the axis of the light beam for aligning the light beam substantially parallel to the surface of the web.

7. Apparatus for monitoring a web of material to determine the presence of irregularities in the surface of the web, web moving over a curved guide surface having an axis of curvature which is oriented transversely to the direction of movement of the web and which guide surface is subjected to sagging deflection in a direction perpendicular to the axis, the monitoring apparatus comprising: means for directing a sharply defined light beam over the surface of the web material in close proximity therewith, the light beam defining a slight angle relative to the axis of curvature to ensure that the light beam is aligned closely parallel to the surface of the web by compensating for the sagging deflection of the guide surface, photoelectric light receiving means for generating an output signal which is responsive to the magnitude of light received thereby, and means positioning the light receiving means so that it receives light from the beam and generates an output signal which is a function of the received light, whereby the entry of the web surface irregularity into the light beam changes the light received by the light receiving means and thereby causes a corresponding change in the output signal.

8. Apparatus according to claim 7 wherein the positioning means locate the light receiving means so that the latter receives the light directly from the means for directing a sharply defined light beam.

9. Apparatus according to claim 7 wherein the positioning means locate the light receiving means so that the latter receives light reflected from the surface of the web.

* * * * *